US008677537B1

(12) United States Patent
Ingesson et al.

(10) Patent No.: US 8,677,537 B1
(45) Date of Patent: Mar. 25, 2014

(54) DOOR BREACHING TOOL WITH SLEDGE HAMMER AND RAKE

(75) Inventors: Lars Ingesson, Hollviken (SE); Patrik Gustavsson, Bunkeflostrand (SE)

(73) Assignee: 5.11 Inc., Modesto, CA (US)

( * ) Notice: Subject to any disclaimer, the term of this patent is extended or adjusted under 35 U.S.C. 154(b) by 166 days.

(21) Appl. No.: 13/199,604

(22) Filed: Sep. 2, 2011

Related U.S. Application Data

(60) Provisional application No. 61/402,742, filed on Sep. 3, 2010.

(51) Int. Cl.
*B25F 1/00* (2006.01)
*B66F 15/00* (2006.01)
*B25D 1/00* (2006.01)

(52) U.S. Cl.
USPC ..... 7/146; 7/166; 7/169

(58) Field of Classification Search
USPC ..... 7/143–147, 166, 169
See application file for complete search history.

(56) References Cited

U.S. PATENT DOCUMENTS

| | | | | |
|---|---|---|---|---|
| 5,865,425 | A * | 2/1999 | Meadows | 254/131 |
| 7,565,711 | B1 * | 7/2009 | Schamadan | 7/145 |
| 7,634,830 | B2 * | 12/2009 | Ryan | 7/166 |
| 7,774,882 | B2 * | 8/2010 | Liou | 7/166 |
| 8,117,702 | B2 * | 2/2012 | Woolley et al. | 7/146 |
| 2005/0102760 | A1 * | 5/2005 | Hayhurst | 7/144 |
| 2009/0000097 | A1 * | 1/2009 | Dapkins et al. | 29/275 |
| 2009/0276962 | A1 * | 11/2009 | Adams et al. | 7/144 |
| 2010/0139008 | A1 * | 6/2010 | Janzen | 7/145 |

FOREIGN PATENT DOCUMENTS

| | | |
|---|---|---|
| EM | 000840681-0001 | 12/2007 |
| EM | 000840681-0002 | 12/2007 |
| EM | 000840681-0003 | 12/2007 |
| EM | 000840681-0004 | 12/2007 |

* cited by examiner

*Primary Examiner* — David B Thomas
(74) *Attorney, Agent, or Firm* — Thomas M. Freiburger

(57) ABSTRACT

A breaching tool for use by law enforcement or emergency personnel has at one end of its handle a sledge hammer and a multi-toothed rake effective to scrape and clean broken glass from a window frame of a building or an automobile. At an opposite or rear end of the handle a tapered chisel tail, preferably with a claw for pulling nails or other fasteners.

11 Claims, 1 Drawing Sheet

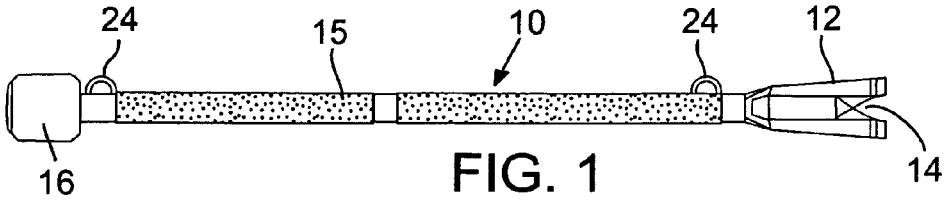
FIG. 1
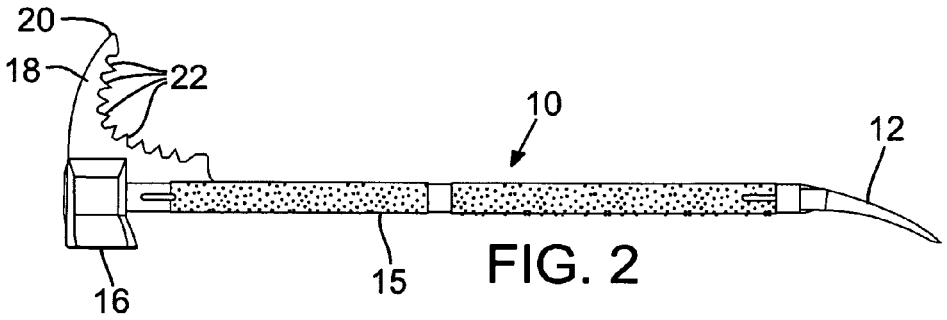
FIG. 2
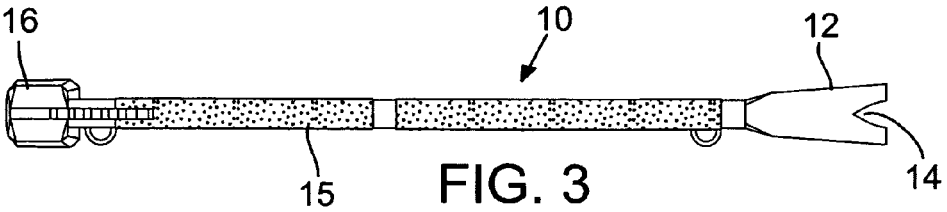
FIG. 3
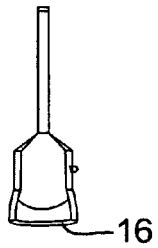
FIG. 4
FIG. 5
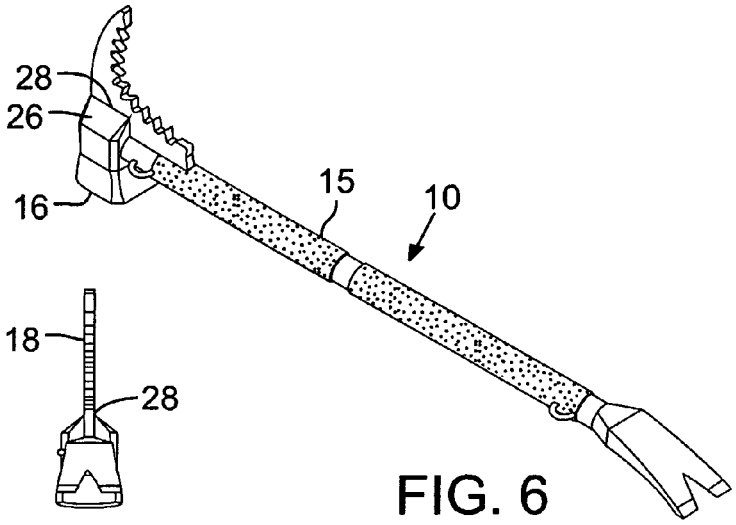
FIG. 6

DOOR BREACHING TOOL WITH SLEDGE HAMMER AND RAKE

This application claims benefit from provisional patent application No. 61/402,742, filed Sep. 3, 2010.

BACKGROUND AND SUMMARY OF THE INVENTION

This invention concerns tools for forced entry of a building or a vehicle, primarily for forcing open doors and windows, the tools typically being used by law enforcement and military tactical teams, search and rescue teams and fire fighters.

Breaching tools are known, including those produced by Sweden Entry Tools of Malmo, Sweden. The tools are usually at least several feet long and are heavy enough to act as levers to pry open a door or other entry using a short head or prying end which is generally at right angles to the length of the tool. Sometimes the tools have been formed into a chisel shape at the other end, the end opposite the tool head, with some curvature to the chisel, also for prying purposes.

The breaching tool of the invention has a principal purpose of quickly and efficiently breaking through windows of buildings and automobiles and safely clearing glass fragments for entry. Another purpose is breaching of doors, primarily wood and plastic doors.

The tool has a tail end with a claw for pulling nails and other fasteners, and a head end that includes a sledge hammer at a lower side and "rake" at an upper side configured to scrape out broken glass from a frame of a car or building window. The rake element, which preferably comprises a series of teeth set in a curve or arc of about 90°, has a pointed end that can be used to penetrate doors.

In one aspect of the invention the subject breaching tool forms part of a kit with another breaching tool marketed by the assignee of this invention.

It is among the objects of the invention to provide a tool for efficient breaching of building and vehicle windows in emergency situations, and also allowing breaching of doors. These and other objects, advantages and features of the invention will be apparent from the following description of a preferred embodiment, considered along with the accompanying drawings.

DESCRIPTION OF THE DRAWINGS

FIG. 1 is a bottom plan view showing a breaching tool of the invention.

FIG. 2 is a side elevation view of a breaching tool.

FIG. 3 is a top plan view of the breaching tool.

FIG. 4 is an end view of the tool as viewed from the tail end of the tool.

FIG. 5 is a end view as viewed from the head end of the tool.

FIG. 6 is a perspective view showing the tool.

DESCRIPTION OF PREFERRED EMBODIMENTS

The tool 10 illustrated in FIGS. 1 through 6 is a special duty breaching tool, particularly adapted for use as a sledge hammer, as a "rake" for cleaning out glass from a window or a door frame after breaking the glass, and for removal of fasteners. The sledge hammer function is useful with other breaching tools such as disclosed in copending provisional application Ser. No. 61/402,741, filed on the same day as this application. The disclosure of the copending application is hereby incorporated by reference.

As shown in the drawings, the tool 10 may be about 0.7 meter in length, or about 28 inches (or a range of about 26 to 29 inches), and includes a chisel tail end 12 which is curved as shown, preferably with a claw 14 for pulling nails and other fasteners. The forked tip providing the claw 14 does not interfere with the use of the chisel end 12 for other functions such as entering and prying via a narrow opening or slot, such as at the edge of a window or door, or breaking a wood frame or otherwise prying using the chisel. A tool shaft or handle 15 is secured to the tail end 12 (as by welding) and preferably has a knurled gripping surface as indicated.

At the head end of the tool, secured to the handle 15, is a sledge head or sledge hammer 16, shown in a position which can be considered the bottom side of the tool. The sledge hammer can be used to breach some doors, break glass from windows of dwellings, other buildings or vehicles, or to drive other breaching tools into position for breaching a door. The weight of the tool may be about 6.5 pounds, or in a range of about 5 to 7.5 pounds, and a large proportion of this weight is in the sledge head 16.

Also at the head end of the tool is a "rake" 18, preferably in the configuration shown. The rake has a pointed end 20 and a series of teeth 22, preferably in an internally curving or arcuate array as shown. The front or exterior surface of the rake 18 may be convexly curved as shown.

The tool 10 makes quick work of breaching windows or glass doors. The glass can be smashed using the sledge 16 or the pointed end 20 of the rake 18, or simply by pushing the head end of the tool through the glass. The teeth 22 of the rake allow for quickly cleaning out broken glass along the edges of the window or door, including laminated car or truck window glass or hardened window glass. The end 20 of the rake also helps penetrate plastic and wooden doors and some metal doors. With the upper end of the rake extending approximately at a 90° angle from the length of the tool, this provides a perpendicular striking force from the grip or shaft 15, thus maximizing power when striking the surface of a window.

As seen in the drawings, the tool 10 can have formed on the handle 15 loop eyes 24 for attachment of a sling to carry the tool.

The handle 15, sledge hammer 16 and rake 18 can be efficiently secured together by a hole (not clearly shown) in the back side of the sledge hammer into which the handle end is fitted, and the hammer being an upper side 26 with a slot 28 into which the rake is fitted. The handle is welded to the sledge hammer and the rake, and the rake is also welded to the sledge hammer.

The described tool can make up a kit with another breaching tool of the assignee of this invention, preferably the second embodiment described in copending provisional application Ser. No. 61/402,741, incorporated herein by reference. Together with the tool of the copending application, which can be about five pounds in weight, the tool of the invention makes up a complete door breaching kit, light and small enough to carry in a patrol car. The kit consisting of the two tools can be used for virtually any kind of door including ingoing and outgoing wooden and steel doors. In addition, the break and rake function provided by the tool 10 allows fast and easy penetration of windows of cars and buildings with cleaning of edge glass. The kit provides for fast and efficient entry of almost all doors and windows.

Dimensions of a preferred embodiment of the tool 10 are as follows:

Tool length: Approximately 0.7 meter (about 26 to 29 inches)

Tool weight: Approximately 6.5 pounds (about 5 to 7.5 pounds)

Lateral dimensions of sledge hammer: Approx. 52-60 mm wide by 50-55 mm front to back Extension of rake upwardly from center of handle to tip 20: Approximately 124-130 mm Spacing between teeth 22: Approximately 10-15 mm The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A breaching tool for forcing or breaking open a door, window or other entry, comprising:

an elongated, generally straight shaft or handle, a head on one end of the shaft, the head comprising a sledge hammer extending downward from said one end of the handle and a rake extending upward from said one end of the handle, opposite the sledge hammer, the rake including a series of teeth arranged in an inwardly curving array at a position generally facing rear on the tool, toward an opposite end of the shaft or handle, the rake being effective to scrape and clear glass fragments from a window frame, and a tail at said opposite end of the shaft, the tail comprising a tapered prying wedge.

2. The breaching tool of claim 1, wherein the array of teeth curves through an angle of about 90°.

3. The breaching tool of claim 1, wherein the teeth of the rake are at about 10 to 15 mm spacing.

4. The breaching tool of claim 1, wherein the rake has a pointed upper end, the rake extending approximately perpendicularly from the handle.

5. The breaching tool of claim 1, wherein the tool has a weight of about 5 to 7.5 pounds.

6. The breaching tool of claim 1, wherein the length of the tool is about 26 to 29 inches.

7. The breaching tool of claim 1, wherein the sledge hammer has dimensions of about 52 to 60 mm wide and about 50 to 55 mm front to back.

8. The breaching tool of claim 1, wherein the shaft or handle is attached to the sledge hammer of the head by a hole in the sledge hammer into which said one end of the handle extends, the handle being welded to the sledge hammer, and the sledge hammer having an upper side with a vertical slot into which the rake is positioned, the rake being welded to the sledge hammer and to the handle.

9. The breaching tool of claim 1, wherein the tail of the tool curves downwardly toward an end of the tail.

10. The breaching tool of claim 1, wherein the tail of the tool has a claw for pulling nails or other fasteners.

11. The breaching tool of claim 1, wherein the handle includes a pair of spaced apart loop eyes for connection of a carrying sling.

* * * * *